US008026455B2

(12) United States Patent
Liu

(10) Patent No.: US 8,026,455 B2
(45) Date of Patent: Sep. 27, 2011

(54) CONNECTOR STRUCTURE OF WATERPROOF AND EXPLOSION-PROOF BUTTON

(75) Inventor: Chih Hsiung Liu, Taipei (TW)

(73) Assignee: Moxa Inc., Shing Tien, Taipei County (TW)

( * ) Notice: Subject to any disclaimer, the term of this patent is extended or adjusted under 35 U.S.C. 154(b) by 403 days.

(21) Appl. No.: 12/318,071

(22) Filed: Dec. 22, 2008

(65) Prior Publication Data

US 2010/0155205 A1 Jun. 24, 2010

(51) Int. Cl.
*H01H 9/04* (2006.01)

(52) U.S. Cl. ..... 200/302.1

(58) Field of Classification Search ..... 200/302.1, 200/302.2, 302.3, 308, 333, 296, 330, 314, 200/304, 306, 293, 43.18, 334
See application file for complete search history.

(56) References Cited

U.S. PATENT DOCUMENTS 3,246,110 A * 4/1966 Hermanson et al. ..... 200/314
3,287,516 A * 11/1966 Nielsen ..... 200/47
6,093,900 A * 7/2000 Wisskirchen et al. ..... 200/302.2
6,949,711 B1 * 9/2005 Litteer ..... 200/43.01

* cited by examiner

*Primary Examiner* — Edwin A. Leon
(74) *Attorney, Agent, or Firm* — Bacon & Thomas, PLLC

(57) ABSTRACT

A connector structure of waterproof and explosion-proof button is provided. A waterproof element completely covers the connecting part of the connecting element. By pressing a first button bar of the waterproof element, a second button bar is driven to depress the button therein. A companion part inside the connecting element is connected and fixed with an explosion-proof element. The connector structure thus achieves the waterproof and explosion-proof effects and has the button function at the same time. The structure solves the problem of having too many elements and too complicated assembly process for achieving the waterproof effect in the prior art. According to the structure, the assembly of the connector structure is simple and both waterproof and explosion-proof effects are simultaneously achieved.

8 Claims, 9 Drawing Sheets

CONNECTOR STRUCTURE OF WATERPROOF AND EXPLOSION-PROOF BUTTON

BACKGROUND OF THE INVENTION

1. Field of Invention

The invention relates to a connector structure and, in particular, to a connector structure of waterproof and explosion-proof button whose waterproof element covers its connecting element.

2. Related Art

Buttons are widely used in the control of electronic products. Usual buttons are not waterproof. If a liquid is carelessly poured over the buttons, it often leaks onto the circuit board and causes damages to the electronic elements. The entire electronic product thus cannot function correctly.

To solve the above-mentioned problem, some people propose a waterproof button structure, as shown in FIG. 1. It is a three-dimensional exploded view of the prior waterproof button structure.

The waterproof button structure includes a button ring 81, a button 82, a waterproof layer 83, a piezoelectric element 84, and a button base 85 disposed with a circuit board 851 therein. In particular, the button ring 81 includes an outer ring 811 and an inner ring 812 for squeezing the button 82, the waterproof layer 83 and the piezoelectric element 84 in between, making them tightly stacked together.

After the button 82, the waterproof layer 83 and the piezoelectric element 84 are stacked in sequence, they are inserted from the back of the outer ring 811 of the button ring 81. Afterwards, the inner ring 812 and the outer ring 811 of the button ring 81 are combined. The circuit board 851 in the button base 85 is further electrically coupled to the stack. The voltage released from it is transmitted as a signal to the circuit board 851. Finally, the button ring 81 holding the button 82, the waterproof layer 83 and the piezoelectric element 84 is assembled to the button base 85.

Besides, another waterproof button structure has been proposed. Such a waterproof button structure consists of a hard button cap, an elastic button base, a hard bottom board with several switches, and a hard housing covering the bottom board. The button post protruding downward from the button cap goes through a preformed through hole on the button base. Even though this waterproof button structure is claimed to have the waterproof function, the liquid can still gets in via the through hole when it is immersed in water. This does not only affect the functioning of switches, but also loses the waterproof effect.

There is yet another proposal of the waterproof sealed switch with a single contact. Two electronic contact elements are disposed in a hollow cavity inside the body of a plastic switch. They are surrounded by several protruding tongue chips. A thin insulating plate made of an elastic material covers the body. A hard insulating plate seals the cavity at the bottom of the body. Finally, a metal closing element covers the elastic insulating plate. Several buckle holes formed on the two downward-bending sidewalls of the metal closing element are then matched with the corresponding tongue chips. The elastic insulating plate is press to form liquid sealing. Finally, one presses the hemispherical part extended from the free end of the metal closing element to make the two electronic contact elements touch each other. Such an electrical connection sends out an electrical signal.

Although the waterproof sealed switch with a single contact can achieve the waterproof effect, its closing element and body are made of hard materials. Thus, the entire waterproof button is not flexible and thus not suitable for some special purposes. In addition, machine cleansing often causes collisions and corrosions on the waterproof sealed switch. As a result, the buckle holes and the tongue chips depart from each other, eventually losing the sealing and waterproof effects.

To achieve the waterproof effect, the above-mentioned buttons involve too many elements. This makes the button assembly too complicated and too expensive. In the long run, it is impractical to use too many elements to make such a waterproof button, as they are not cost-effective.

In summary, the prior art has the problem of using too many elements and employing complicated assembly processes to make waterproof buttons. It is highly desirable to provide a solution for this.

SUMMARY OF THE INVENTION

In view of the foregoing, the invention discloses a connector structure of waterproof and explosion-proof button. It includes a connecting element, an explosion-proof element, and a waterproof element.

The connecting element is a hollow body that includes a connecting part, an outer companion part, and an inner companion part. The connecting part is disposed on one end of the connecting element. The outer companion part surrounds the outside of the connecting element. The inner companion part surrounds the hollow portion of the connecting element. The explosion-proof element is connected with and fixed on the inner companion part. The waterproof element has a first button bar and a second button bar. The waterproof element covers the connecting part of the connecting element. The first button bar is disposed in the hollow portion of the connecting part. The second button bar exposes from the waterproof element.

The disclosed structure differs from the prior art in that the invention only has the connecting element, the explosion-proof element, and the waterproof element. The waterproof element completely covers the connecting part of the connecting element. By pressing a first button bar of the waterproof element, a second button bar is driven to depress the button therein. An inner companion part inside the connecting element is connected with and fixed on the explosion-proof element. The connector structure thus achieves the waterproof and explosion-proof effects and has the button function at the same time. The invention solves the problem of having too many elements and too complicated assembly process for achieving the waterproof effect in the prior art. According to the invention, the assembly of the connector structure is simple and both waterproof and explosion-proof effects are simultaneously achieved.

Using the disclosed technique means, the invention can achieve the objectives of simple assembly and waterproof and explosion-proof effects.

BRIEF DESCRIPTION OF THE DRAWINGS

The invention will become more fully understood from the detailed description given herein below illustration only, and thus is not limitative of the present invention, and wherein:

FIG. 8 shows the international industrial dustproof level table; and

FIG. 9 shows the international industrial waterproof level table.

DETAILED DESCRIPTION OF THE INVENTION

The present invention will be apparent from the following detailed description, which proceeds with reference to the accompanying drawings, wherein the same references relate to the same elements.

Figure 1:
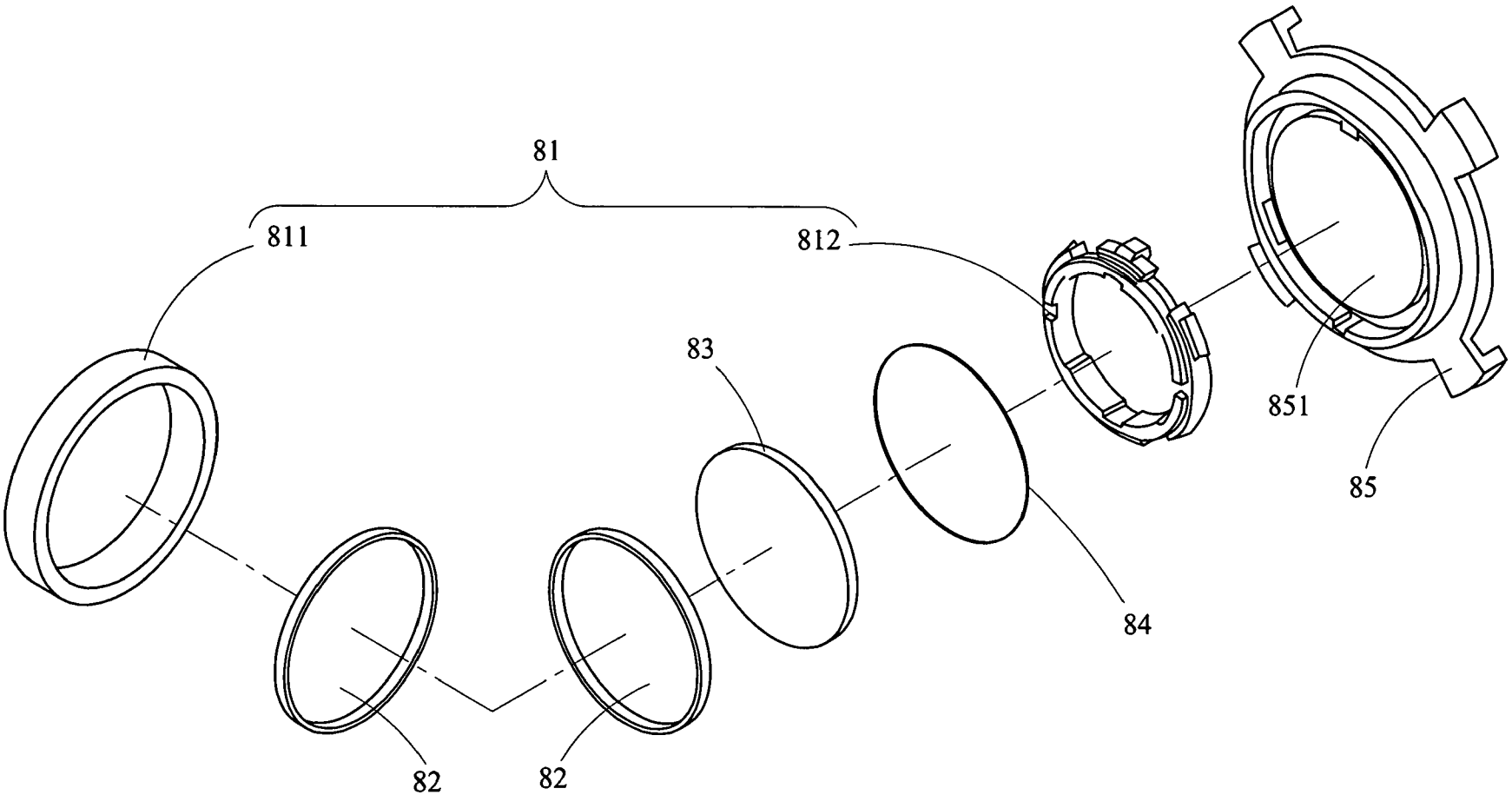
FIG. 1(PRIOR ART)
FIG. 1 is a three-dimensional exploded view of a prior waterproof button structure.
Figure 2:
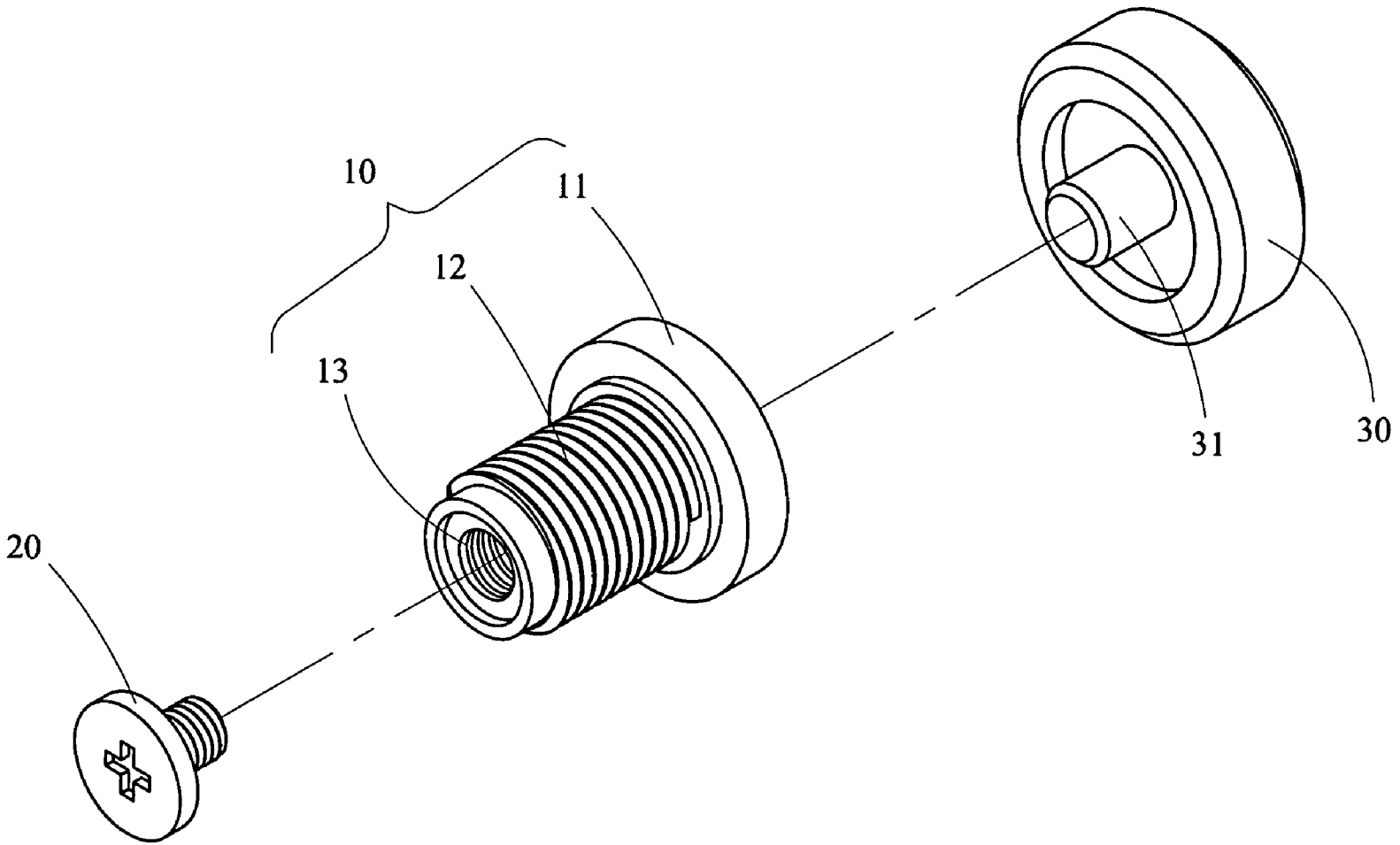
FIG. 2 is a three-dimensional exploded view of the disclosed connector structure of waterproof and explosion-proof button.
Figure 3:
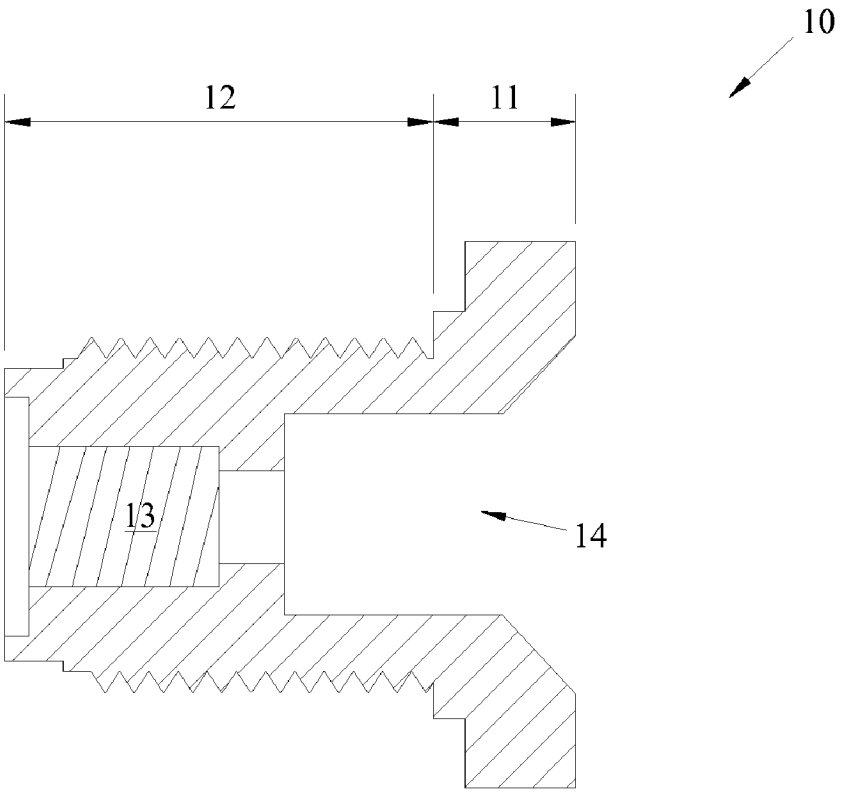
FIG. 3 is a cross-sectional view of the connecting element in an embodiment of the invention.

The following paragraphs first describe the disclosed connector structure of waterproof and explosion-proof button. Please refer to FIGS. 2 and 3. FIG. 2 is a three-dimensional exploded view of the disclosed connector structure of waterproof and explosion-proof button. FIG. 3 is a three-dimensional assembly view of the disclosed connector structure of waterproof and explosion-proof button.

As shown in FIG. 2, the disclosed connector structure of waterproof and explosion-proof button includes a connecting element 10, an explosion-proof element 20 and a waterproof element 30.

The connecting element 10 is made of a metal or polymer. It is a hollow object, including a connecting part 11, an outer companion part 12, and an inner companion part 13. The connecting part 11 is disposed on one end of the connecting element 10. The outer companion part 12 surrounds the outside of the connecting element 10. The inner companion part 13 surrounds the hollow portion of the connecting element 10.

The explosion-proof element 20 is connected with and fixed on the inner companion part 13 of the connecting element 10. The explosion-proof element 20 and the inner companion part 13 are connected by screw fastening or locking.

For example, if the explosion-proof element 20 and the inner companion part 13 are connected by screw fastening, the explosion-proof element 20 is the screw. The inner companion part 13 of the connecting element 10, i.e., the hollow portion on the other end of the connecting element 10, has an inner thread. The explosion-proof element 20 can thus be screw-fastened to the other end of the connecting element 10. This is only one example of the invention and should not be used to restrict the scope of the invention.

Figure 6A:
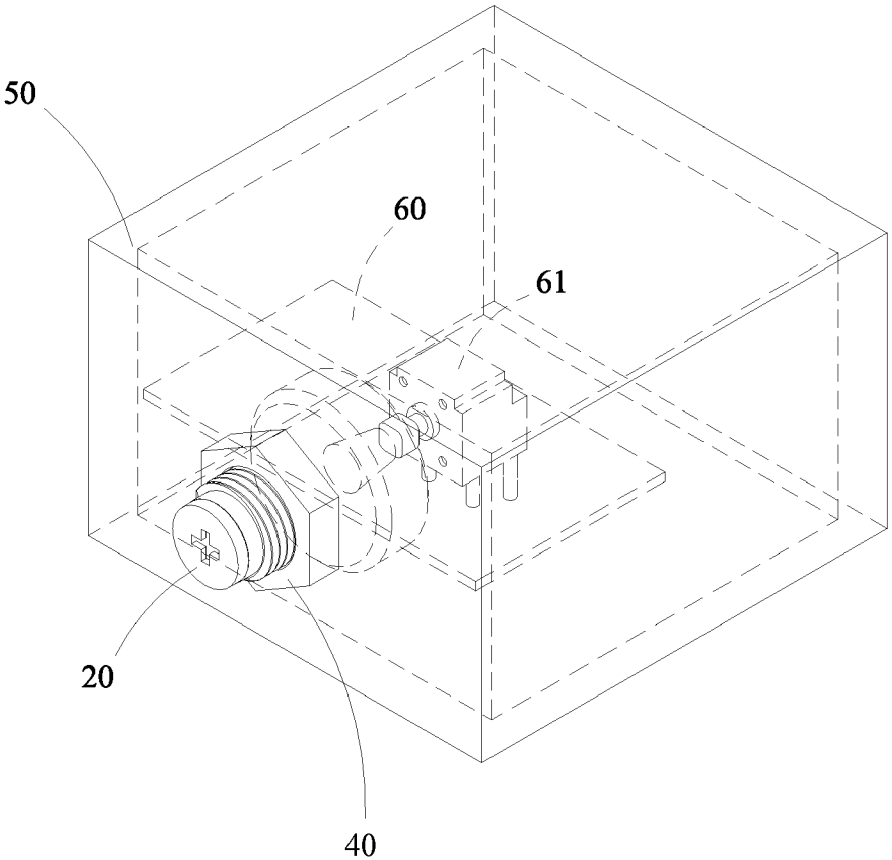
FIGS. 6A and 6B are three-dimensional assembly views of an application of the disclosed connector structure of waterproof and explosion-proof button.
Figure 6B:
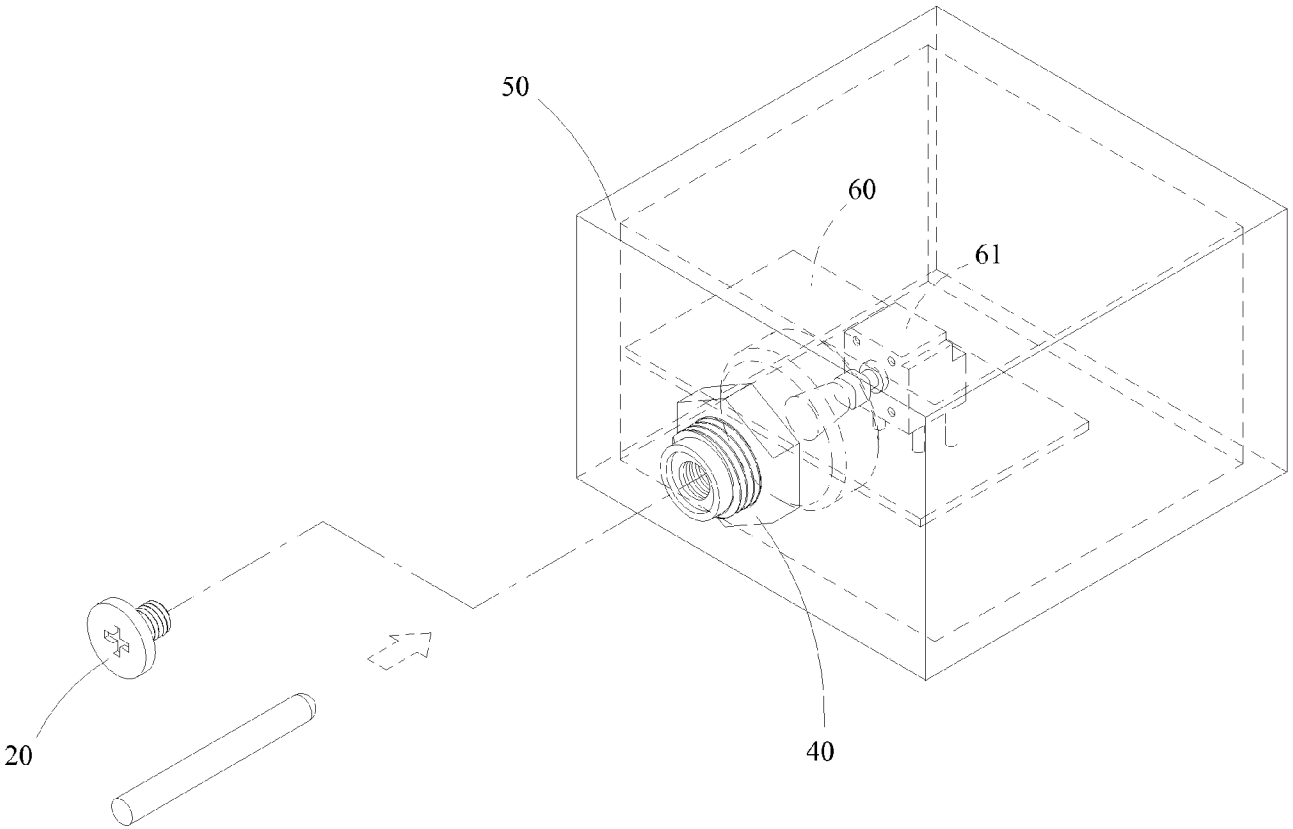

The waterproof element 30 includes a first button bar 31 and a second button bar 32 (see FIG. 6). The waterproof element 30 can completely cover the connecting part 11 of the connecting element 10. When the waterproof element 30 completely covers the connecting part 11 of the connecting element 10, the first button bar 31 is disposed at the hollow portion of the connecting part 11 and the second button bar 32 exposes from the waterproof element 30.

It should be noted that the connecting part 11 of the connecting element 10 has a larger outer diameter than the connecting element 10. Therefore, when the waterproof element 30 covers the connecting part 11 of the connecting element 10, the waterproof element 30 can completely cover it.

In addition, the outer companion part 12 surrounds the outside of the connecting element 10. The range surrounded by the outer companion part 12 does not include the connecting part 11 disposed on one end of the connecting element 10. Moreover, the inner companion part 13 surrounds the hollow portion of the connecting element. But it does cover the hollow portion of the connecting part 11 where the first button bar 31 is disposed.

The waterproof element 30 is made of a more elastic material, such as rubber. This is only one example and should not be used to restrict the scope of the invention. When the waterproof element 30 completely covers the connecting part 11 of the connecting element 10, the elasticity of the waterproof element 30 tightly covers the connecting part 11 of the connecting element 10. Therefore, water, moisture, or some other liquid can be prevented from permeating into the connecting element 10 via its hollow portion.

The above-mentioned connecting element 10, explosion-proof element 20, and waterproof element 30 are assembled to form the disclosed connector structure of waterproof and explosion-proof button, as shown in FIG. 3.

Figure 4:
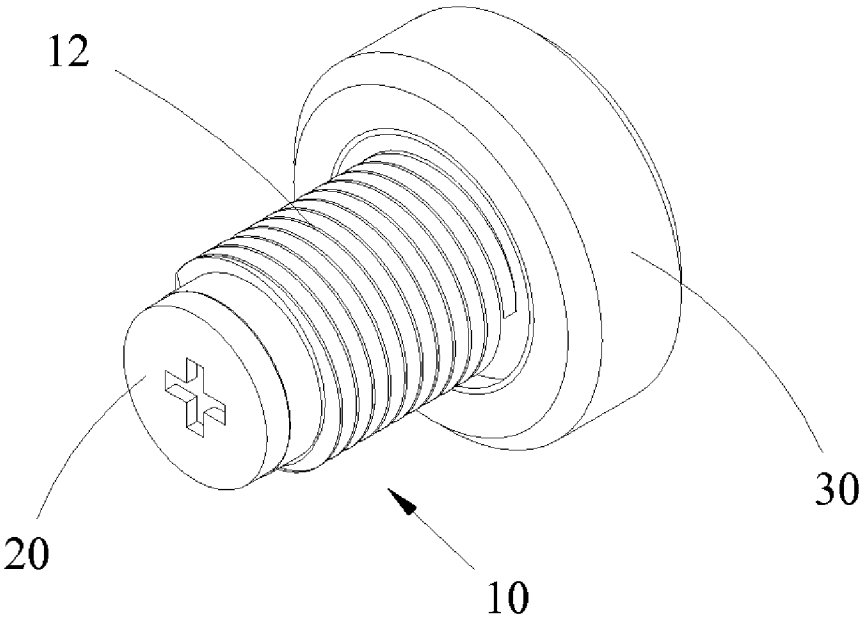
FIG. 4 is a three-dimensional assembly view of the disclosed connector structure of waterproof and explosion-proof button.

FIG. 4 is a three-dimensional exploded view of the disclosed connector structure of waterproof and explosion-proof button. In practice, a fixing element 40 us used to fix the connecting element 10 on a housing 50. The housing 50 is formed with a hole 51 for the connecting element 10 to go through and to be fixed onto the outer companion part 12 using the fixing element 40. The inner side (not shown) of the housing 50 is tightly connected with the waterproof element 30 of the connecting part 11 of the connecting element 10. The connecting part of the hole 51 and the connecting element 10 is also protected by the waterproof element 30 so that water, moisture, or some other liquid does not permeate into it through the connecting part.

Figure 5:
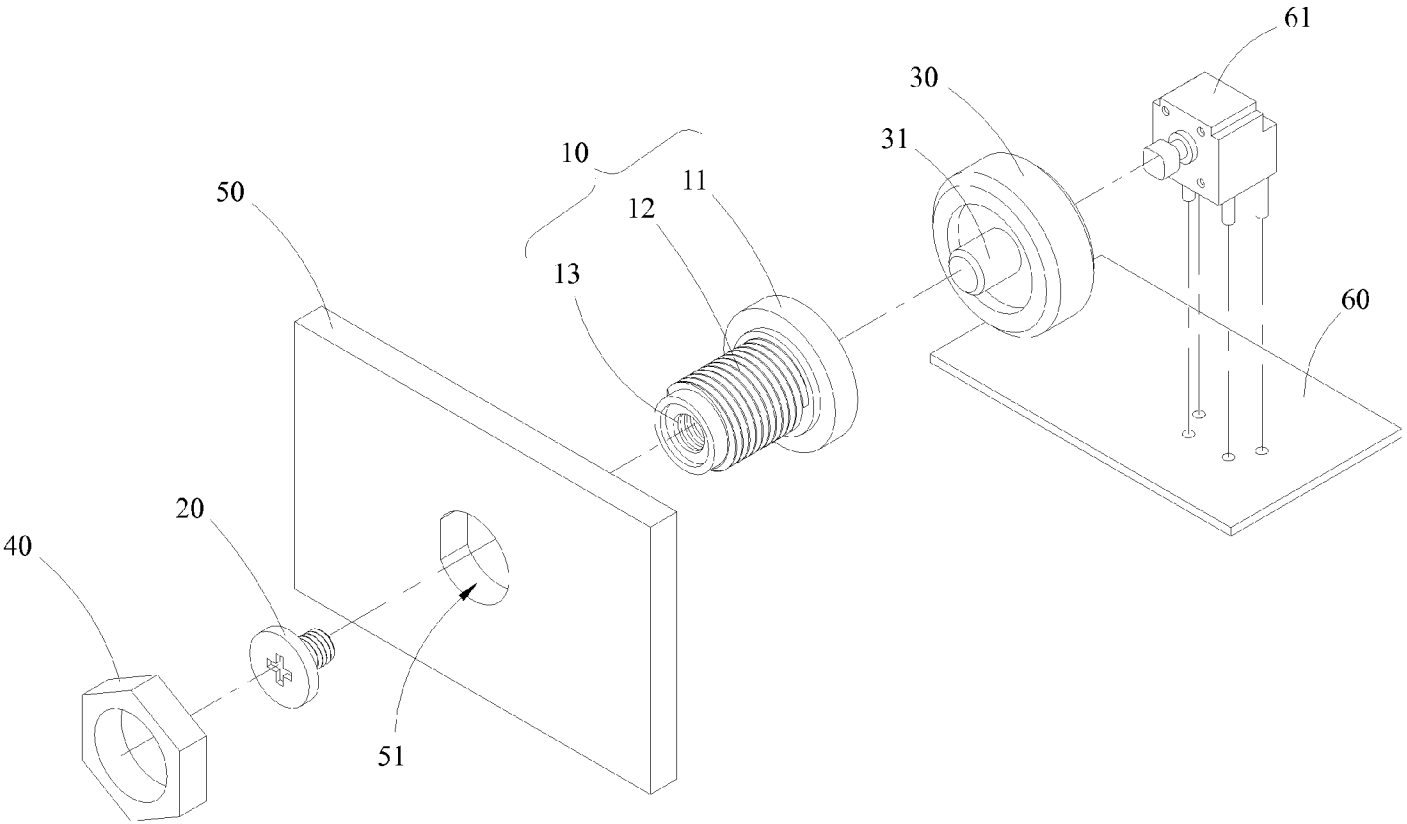
FIG. 5 is a three-dimensional assembly exploded view of an application of the disclosed connector structure of waterproof and explosion-proof button.

FIG. 5 is a three-dimensional assembly view of the disclosed connector structure of waterproof and explosion-proof button. It shows the housing of the disclosed connector structure of waterproof and explosion-proof button and the corresponding circuit board.

Figure 7A:
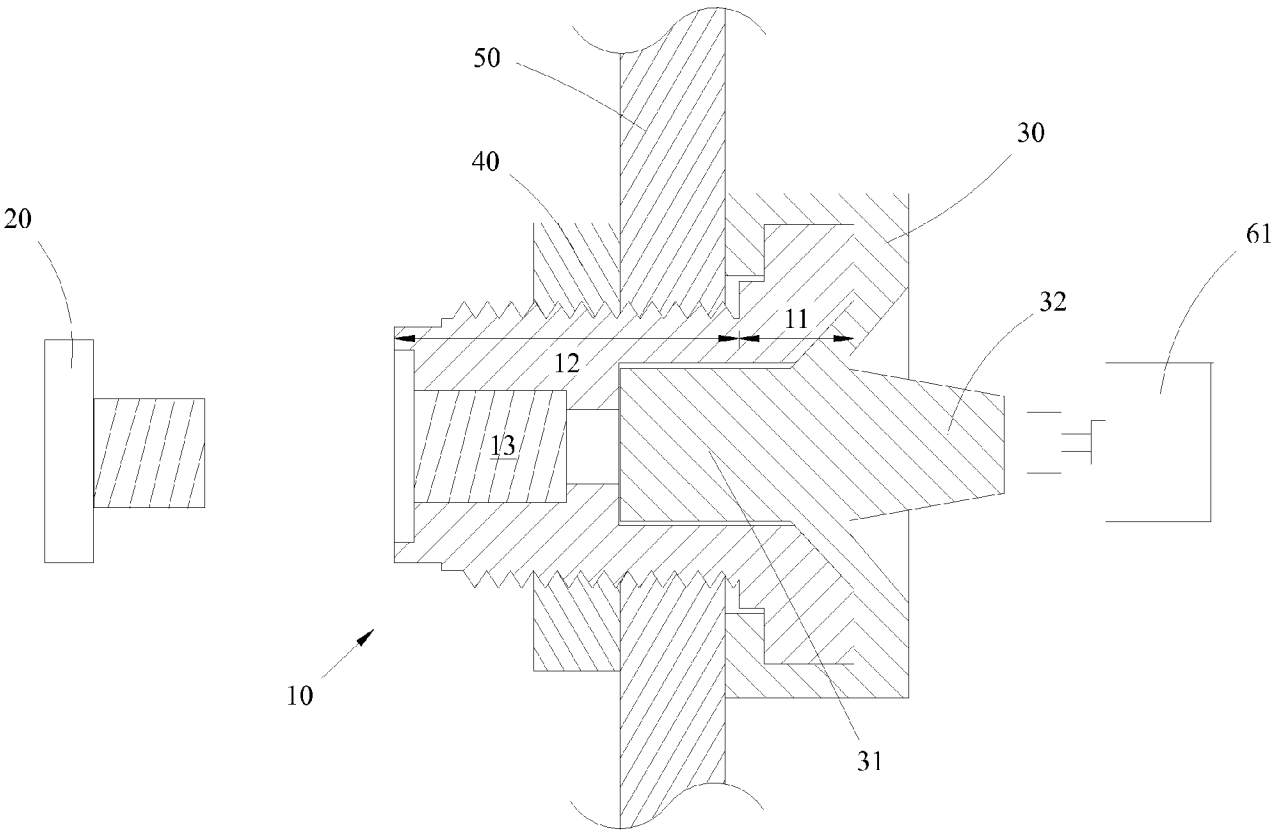
FIG. 7A is a cross-sectional view of the original state of the disclosed connector structure of waterproof and explosion-proof button.
Figure 7B:
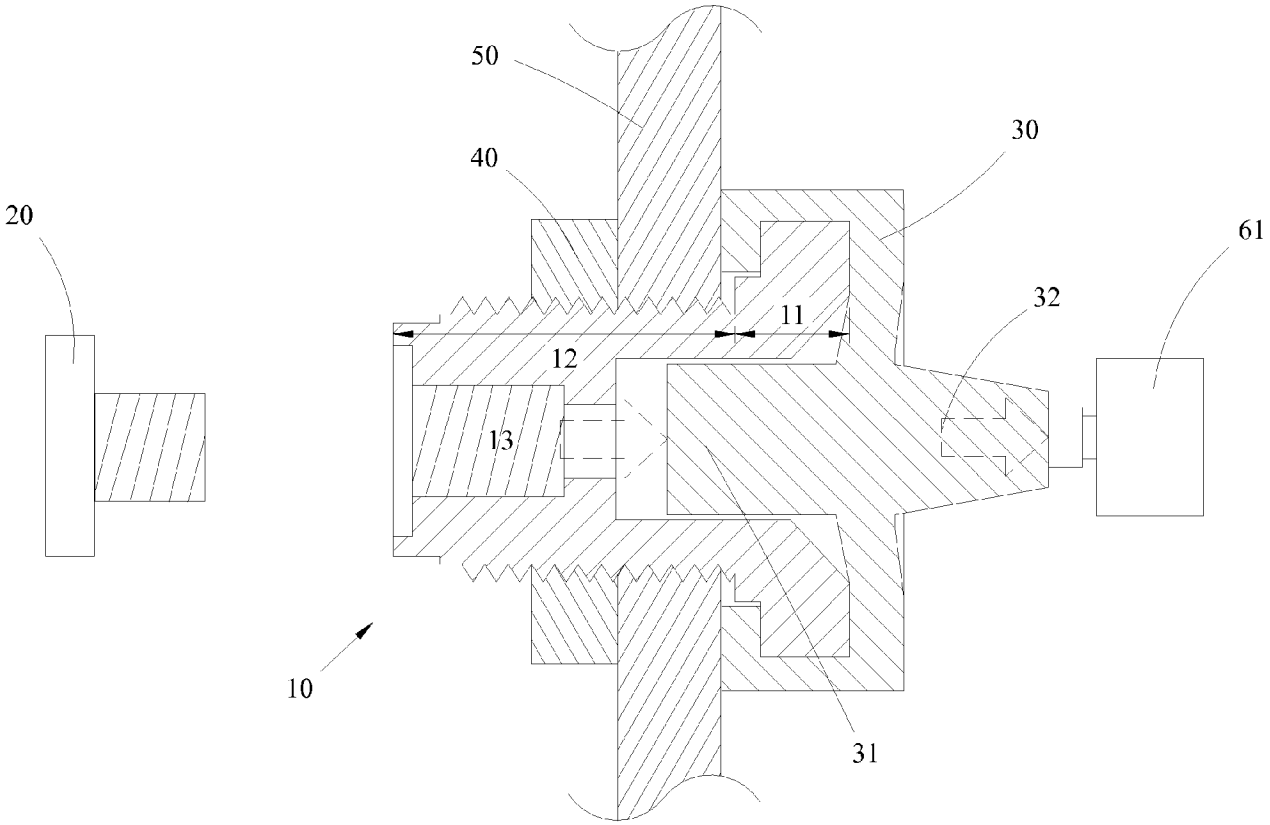
FIG. 7B is a cross-sectional view of the operating state of the disclosed connector structure of waterproof and explosion-proof button.

Please refer simultaneously to FIGS. 5, 6, and 7. FIG. 6 is a cross-sectional view of the original state of the disclosed connector structure of waterproof and explosion-proof button. FIG. 7 is a cross-sectional view of the operating state of the disclosed connector structure of waterproof and explosion-proof button.

The location of the hole 51 on the housing 50 corresponds to the location of the button 61 on the circuit board 60 inside the housing 50. Therefore, when the connecting element 10 is fixed on the housing 50, the second button bar 32 exposed from the waterproof element 30 corresponds to the location of the button 61 on the circuit board 60.

When the user wants to press the button 61, he first has to release the explosion-proof element 20 from the connection with the inner companion part 13 of the connecting element 10. By pressing the first button bar 31 of the waterproof element 30, the first button bar 31 moves along the axial direction of the hollow cavity of the connecting element 10. Concurrently, the second button bar 32 of the waterproof element 30 moves along the axial direction of the hollow cavity of the connecting element 10. The button 61 on the circuit board 60 is indirectly depressed. This then achieves the objective of depressing the button 61.

When the user stops pressing the first button bar 31 of the waterproof element 30, the resilient force of the waterproof element 30 restores the first button bar 31 and the second button bar 32 of the waterproof element 30 to their original state (as in FIG. 6). Finally, the explosion-proof element 20 is connected with and fixed to the inner companion part 13 of the connecting element 10.

It should be noted that the invention can prevent explosion risks. The user is prevented from carelessly triggering the first button bar 31 of the waterproof element 30 at special places (e.g., gas station, natural gas storage tank, etc) that leads to a small spark produced as the second button bar 32 presses the button 61. Therefore, the invention avoids a gas explosion. This only serves as one example and should not be used to restrict the applications of the invention.

In addition to the waterproof function, the waterproof element 30 also has the function of a button. Along with the explosion-proof element 20, the combination of the connecting element 10, the explosion-proof element 20, and the waterproof element 30 can achieve the waterproof and explosion-proof effects. It greatly reduces the production cost and the number of elements used in the connecting elements.

The waterproof and explosion-proof effects of the invention can be tested according to the international industrial standard waterproof levels. Through such a test, the waterproof level of the invention can be reliably determined.

The test of international industrial standard waterproof levels has different testing methods for different levels. Higher levels mean a better waterproof effect. The product using the disclosed connector structure of waterproof and explosion-proof buttons is tested according to the examination standard within a short time. The test condition is as follows. The product using the invention is immersed in a water tank. The size of the water tank should be such that after full immersion the distances from the bottom and top of the product to the water surface are at least 1 m and 0.15 m, respectively. The test time is 30 minutes.

This examination standard is the level-7 international industrial waterproof standard. The product using the invention indeed passes the test. Therefore, the disclosed connector structure of waterproof and explosion-proof buttons reaches level IP67 of the international industrial waterproof standard.

Please refer to FIGS. 8 and 9 for the international industrial waterproof standard. FIG. 8 shows a table of international industrial standard dustproof levels. FIG. 9 shows a table of international industrial standard waterproof levels. As shown in the international industrial standard dustproof level table 71 and the international industrial standard waterproof table 72, the invention can completely prevent dusts from entering and be waterproof within a short time.

According to the above description, the disclosed connector structure of waterproof and explosion-proof button achieves waterproof, explosion-proof and dustproof effects. As far as assembly is concerned, one only uses the waterproof element 30 to cover the connecting part 11 of the connecting element 10. The connecting element 10 goes through the hole 51. It is then connected with and fixed on the outer companion part 12 using the fixing element 40. The explosion-proof element 20 is then connected with and fixed on the inner companion part 11 of the connecting element 10. The assembly method is simpler.

In summary, the invention differs from the prior art in the use of the connecting element, the explosion-proof element, and the waterproof element only. The waterproof element completely covers the connecting part of the connecting element. By pressing the first button bar of the waterproof element, the second button bar is driven to depress the button therein. The inner companion part inside the connecting element is connected with and fixed on the explosion-proof element. The connector structure thus achieves the waterproof and explosion-proof effects and has the button function at the same time. The waterproof effect is achieved without using too many elements. At the same time, the assembly process is simple.

The invention solves the problem of having too many elements and too complicated assembly process for achieving the waterproof effect in the prior art. According to the invention, the assembly of the connector structure is simple and both waterproof and explosion-proof effects are simultaneously achieved.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A pushable connecting structure, comprising:

a hollow bolt having a first opening at a bottom of an externally threaded shank part and a second opening at a head part, wherein a hollow portion of the hollow bolt has an internal threaded part extending from the first opening and a rod-accommodating portion extending from the second opening;

a flexible waterproof cap, which seamlessly covers the head part of the hollow bolt, having a first rod and a second rod protruded from opposite surfaces of the flexible waterproof cap, wherein the first rod is substantially received in the rod-accommodating portion of the hollow bolt, and the second rod is moved to engage an actuator when a pushing force is applied to the first rod from the first opening; and a removable screw, which is screw-fastened to the hollow bolt, wherein the removable screw mates with the internal threaded part and seals the first opening of the hollow bolt.

2. The pushable connecting structure as in claim 1, wherein the hollow bolt is made of metal or polymer.

3. The pushable connecting structure as in claim 1, wherein the diameter of the head part of the hollow bolt is greater than the diameter of the externally threaded shank part.

4. The pushable connecting structure as in claim 1, wherein the rod-accommodating portion of the hollow bolt is not overlapped with the inner threaded part.

5. An apparatus, comprising:

a housing;

a circuit board configured in the housing;

an actuator disposed on the circuit board; and a pushable connecting structure fixed on the housing by a threaded nut, wherein the pushable connecting structure further comprising:

a hollow bolt having an externally threaded shank part, a first opening at the bottom of the externally threaded shank part, and a second opening at a head part of the hollow bolt, wherein a hollow portion of the hollow bolt has an internal threaded part extending from the first opening and a rod-accommodating portion extending from the second opening;

a flexible waterproof cap, which seamlessly covers the head part of the hollow bolt, having a first rod and a second rod protruded from opposite surfaces of the flexible waterproof cap, wherein the first rod is substantially received in the rod-accommodating portion of the hollow bolt, and the second rod is moved to engage the actuator when a force is applied to the first rod from the first opening; and a removable screw, which is screw-fastened to the hollow bolt, wherein the removable screw mates with the internal threaded part and seals the first opening of the hollow bolt.

6. The apparatus as in claim 5, wherein the hollow bolt is made of metal or polymer.

7. The apparatus as in claim 5, wherein the diameter of the head part of the hollow bolt is greater than the diameter of the shank part.

8. The apparatus as in claim 5, wherein the first accommodating portion of the hollow bolt is not overlapped with the inner threaded part.

* * * * *